US006234209B1

(12) United States Patent
Viegener

(10) Patent No.: US 6,234,209 B1
(45) Date of Patent: May 22, 2001

(54) OUTFLOW SPOUTS OF FAUCET SETS

(76) Inventor: Francisco Enrique Viegener, 1053 Bernardo de Irigoyen Street, 1602, Florida, Buenos Aires State (AR)

( * ) Notice: Subject to any disclaimer, the term of this patent is extended or adjusted under 35 U.S.C. 154(b) by 0 days.

(21) Appl. No.: 09/335,738

(22) Filed: Jun. 18, 1999

(30) Foreign Application Priority Data

Jun. 19, 1998 (AR) ..... 98 01 02953

(51) Int. Cl.[7] ..... E03C 1/04
(52) U.S. Cl. ..... 137/801; 4/678; 251/155
(58) Field of Search ..... 4/678; 137/801; 251/155

(56) References Cited

U.S. PATENT DOCUMENTS 1,187,613 * 6/1916 Divekey ..... 251/155
4,852,192 * 8/1989 Viegener ..... 4/678

* cited by examiner

*Primary Examiner*—Gerald A. Michalsky
(74) *Attorney, Agent, or Firm*—Michael D. Bednarek; Shaw Pittman

(57) ABSTRACT

The characterization of this spout is that its body has a support and fixing base connected to the appliance with a spindle connected to the fluid power supply that ends in the interior of a top cap that rests on this base and provides the sleeve of the said spout, delimiting between both pieces an intercommunication chamber of the spindle with this sleeve that enables the incorporation of an assembly-head of an obturator of fluid passage control, including retention elements of both pieces between them with respective hermetic means.

2 Claims, 3 Drawing Sheets

OUTFLOW SPOUTS OF FAUCET SETS

BACKGROUND OF THE INVENTION

Field of the Invention

The present invention relates to improvements in outflow spouts of faucet sets, in which the corresponding spout base in the device has a tubular spindle to the connection to the power supply.

According to the conventional technique, the said spouts are built as a whole entire piece which provides to the said spout base, generally as a plane support base, in which the tubular spindle is an integrated part of this piece or a false piece screwed or welded to obtain a linked set.

This set normally involves a big mass of material which makes the obtention of its duct work extremely complex, resulting from this, an important design restriction and a significant cost problem.

On the other hand, according to the general conception of the said spouts making, it is almost possible to produce them in plastic materials using common molded techniques which would allow a great reduction in the element costs and an increase in the creation of new designs.

Another inconvenience of the conventional spouts is that when fixing to the element where the integrating faucet set is applied to, the orientation of the said spouts must be taken care when adjusting the fixing elements, for example in a washbasin, it is necessary to fix firmly the spout rightly orientated while adjusting the fixing nut screwed on the edge of the said tubular spindle that stands out behind the appliance.

SUMMARY OF THE INVENTION

As for the aforementioned, it must be stated that it is a basic object of the invention to obtain a new constructive conception to obtain these spouts which require proportionally very reduced mass, only limited to a very thin wall in the overall extension of its outer surface.

In other words, it could be stated that it is necessary that these spout bodies can be assimilated to a solid cover of reduced mass in comparision with the required in the conventional spouts, made of any material, preferably plastic, in whose base it would be possible to develop any design when allowing the application of the most modern molded techniques not only in the exterior but also in the interior.

It is also a basic object of the present invention that even when two or more pieces are required to build the spout body, the said pieces are made of and result from, specially in the event of plastic, no additional operations of adjustment and/or finishing in the building and/or incorporation to the faucet set to which have been assembled; this is so, that can be used as they were built in the matrix.

It is a further object of the present invention to provide an innovate constructive disposition in accordance with herein explained, that enables to develop integrated conjoints of spouts and outflow control valves in the same body of easy assembly and mantenaince and in such conditions that the same spouts can be used indistinctly with or without such valve.

It is of special interest and in relation with the object abovementioned to obtained that in this valve and spout conjoint will be possible to use valves whose operative parts are entirely contained in a replaceable cartridge-head for example that can be easily incorporated to a corresponding housing of the spout body as a part of it, regarding the security of the adjusting of its components independantly of the function as outflow control element.

It is also of special interest that a replaceable cartridge-head valves of any known models can be used and for example a metallic head with an up and down obturator or with ceramic obturator of a ¼ turn can be also used in spout made entirely in plastic.

All of them in such conditions that said valve cartridge-head can be removable and replaceable by another by the user without affecting the spout assembly or its connection to other pieces of the set or its fixing to the support wherein the abovementioned is applied.

Another object of the present invention is to obtain that the spout can be easily fixed to the appliance or other element without taking care of its orientation in such conditions that said orientation can have later adjustment regardless the fixing grade.

BRIEF DESCRIPTIONS OF THE DRAWINGS

For clarity and better understanding of the spouts resulting from the application of the invented improvements, the present invention is illustrated by way of example according to two preferred embodiments, wherein:

FIG. 1 shows a top perspective and A—A longitudinal section view of the spout according to the embodiments and basic disposition of their components.

FIG. 1' shows the same view of FIG. 1 but exploded.

Figure 3:
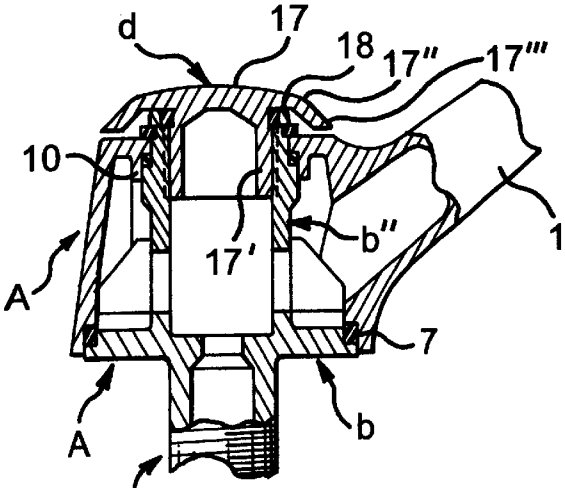
FIG. 3 shows a partial view of FIG. 1 according to a first disposition of complementary elements of the basic embodiments illustrated herein.
Figure 3:
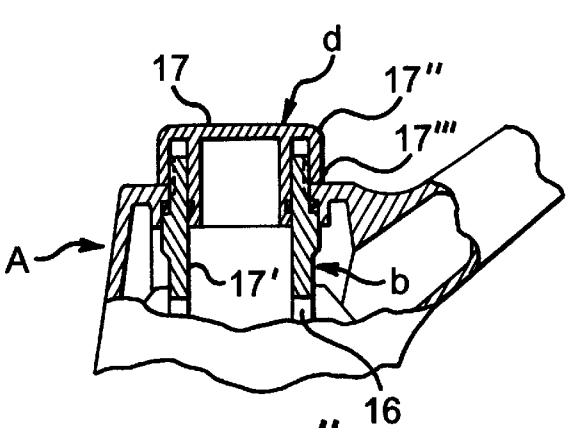
Figure 3:
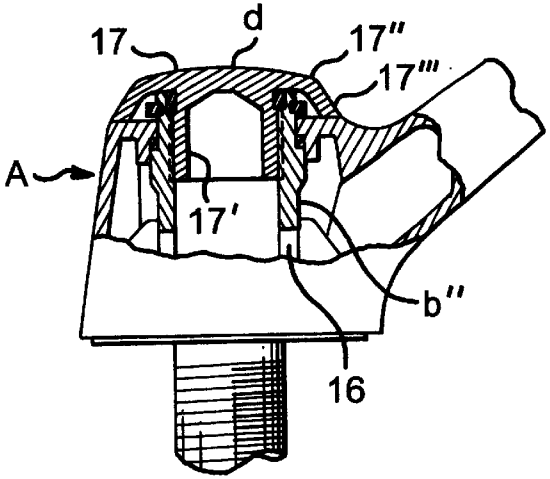

FIGS. 3' and 3" show same view of FIG. 3 according to two differences in such complementary element disposition.

Figure 1:
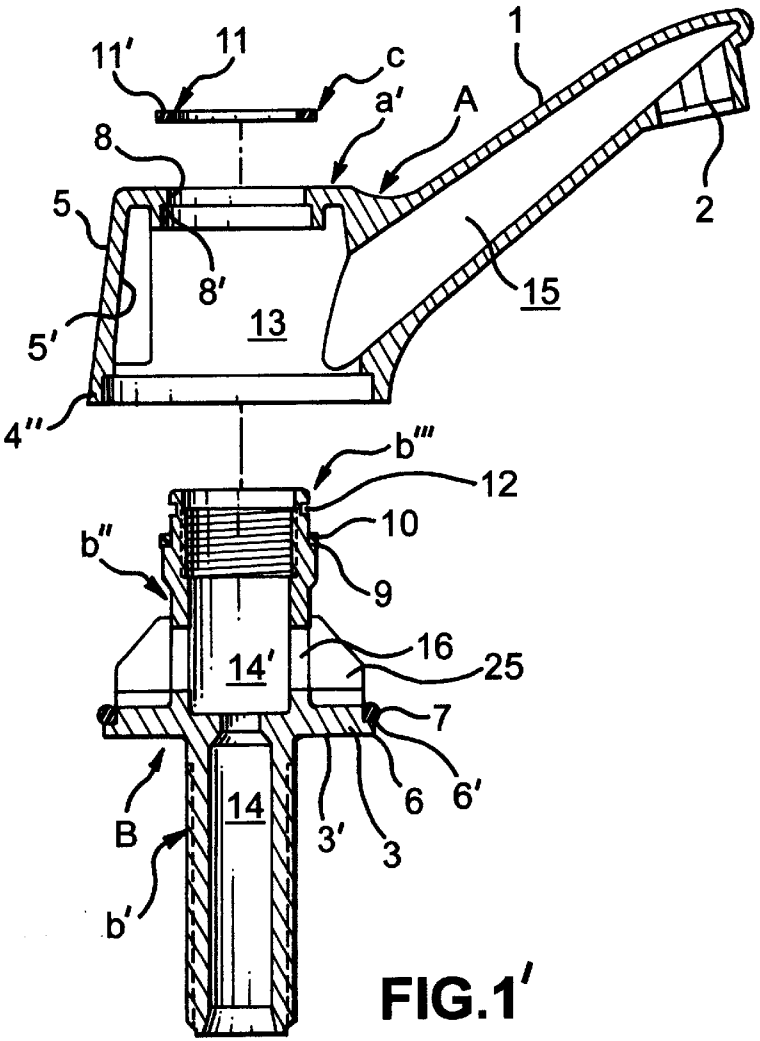
Figure 1:
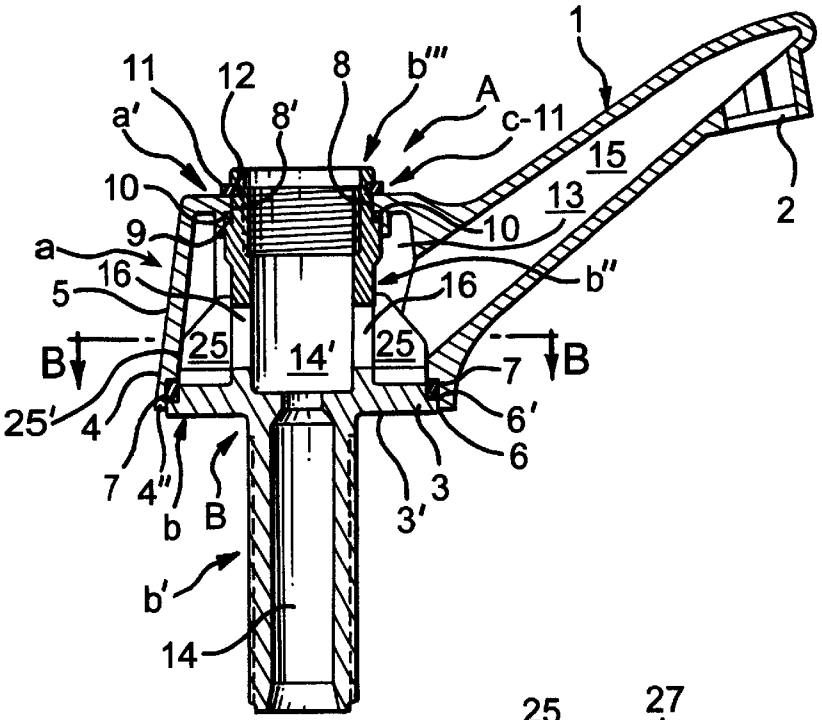
Figure 4:
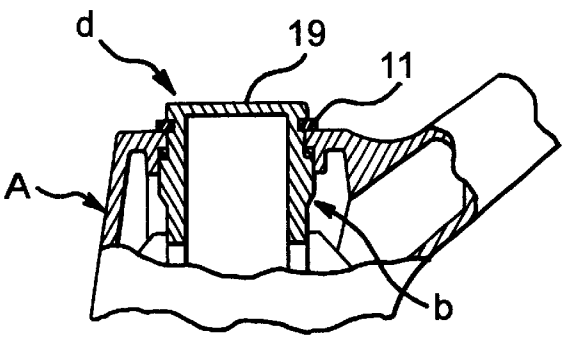
Figure 4:
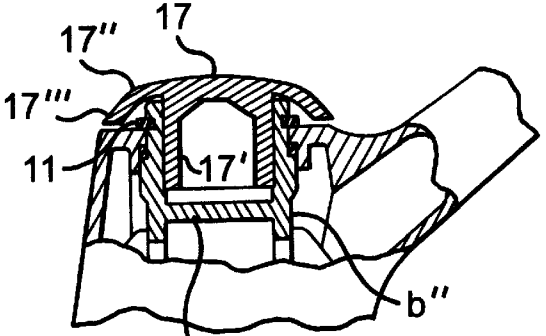

FIG. 4 shows same view of FIG. 3 according to a second disposition of a complementary element of the embodiment of FIG. 1.

FIG. 4' shows same view of FIG. 4 with a difference in the disposition of a complementary element.

Figure 5:
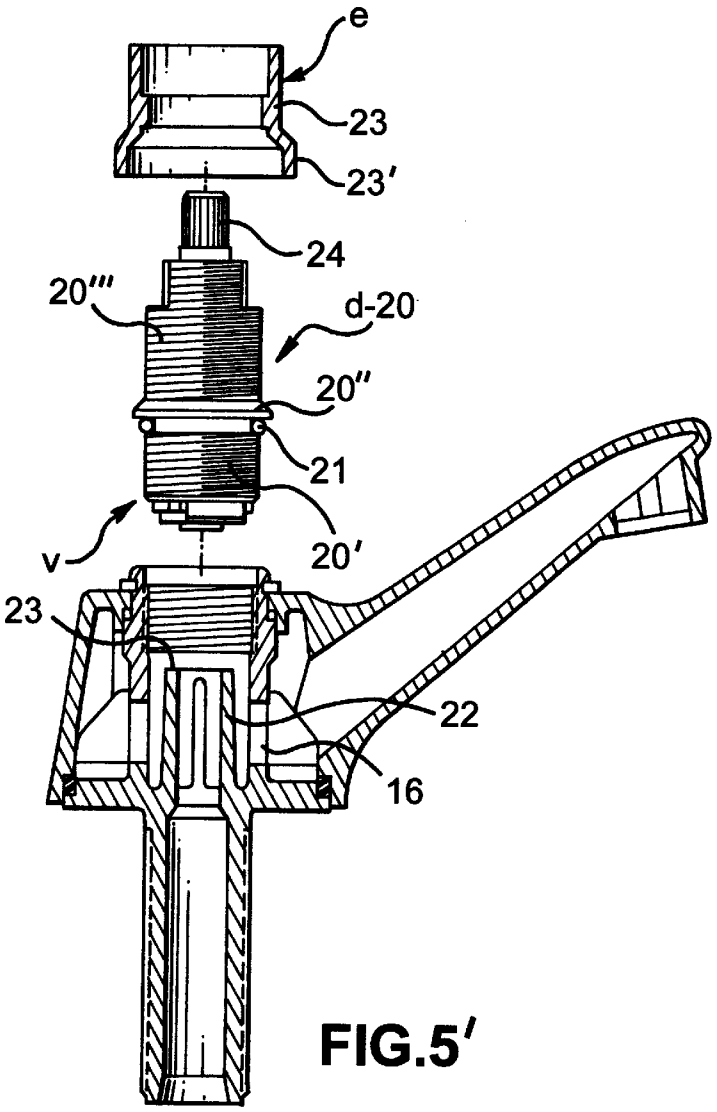
Figure 5:
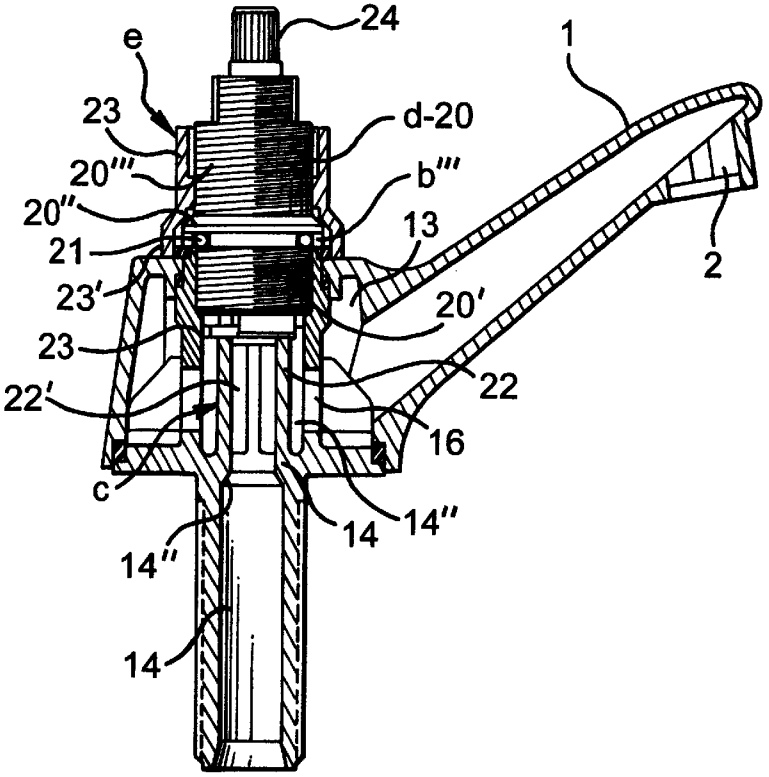

FIG. 5 shows the same view of FIG. 1 according to a second exemplary embodiment in which the basaic embodiment has a valve as an integrating part of the spout.

FIG. 5' shows the same view of FIG. 5 but in partial exploded view.

In all figures like reference characters identify correspondingly throughout.

DESCRIPTION OF THE PREFERRED EMBODIMENTS

According to the explanation and the illustrations above, invented improvement has been developed in relation to outflow spout of the so called faucet sets used in different devices such as washbasin and similar.

The set spout has, in opposition to its nose of fluid outflow, a support base in the element to which it will be fixed, with a tubular spindle or nose of connection to the power supply, according to any distribution system and fluid outflow control.

Figure 2:
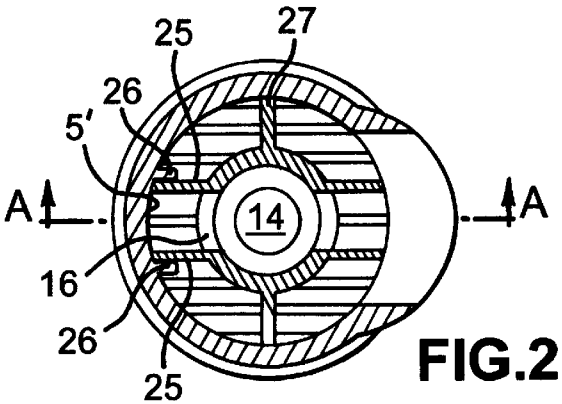
FIG. 2 shows outer elevation view and B—B cross sectional view with a position against rotation between both component parts of the spout, according to FIG. 1'.

According to this improvement the innovation of the present invention can be centralized as illustrated in FIGS. 1 and 2.

The spout has two pieces, one that is the properly said spout body A and the other its support base B with the set spindle or nose with connection to the power supply, with this two pieces connected removable and hermetically between them developing a set as explained hereof.

the spout piece A has an inferior part of direct connection to base piece B made up as a top cap a from which a tubular extension 1 is extended to form the spout sleeve that ends in the corresponding nose 2 of ouet fluid outlet.

The base piece B is formed by a discoidal plaquelet b, of a proportionally reduced thickness, circular in this example, with the said tubular spindle b' formed as an integrating part of the said platelet outcoming of the respective outer support surface 3.

The said top cap a adapts to periphery 4 of the lateral wall 5 and over and arround periphery 6 of the base platelet b, adjusting hermetically between both peripheries by a first "O" ring 7 screwed in between confronted steps 4'–6' of each one and laterally restrained by a short skirt 4" of the top cap which ends in an edge substantially leveled of said support 3 of the platelet b.

The present disposition is not limited, thus, this skirt 4" should lay over a flap of the top cap periphery after that the "O" ring will be rightly screwed in.

The base platelet b, has in its exterior or interior, in opposition to spindle b' a tubular central projection b" which has an inner communication with the duct of the spindle and ends in an edge nose b'" that runs with movable adjustment through a slot 8 of the crown wheel a' of the top cap a which together with said nose has inner annular cooperative steps 8' and 9, and a second "O" ring 10 is screwed in between them and by means of which an inner hermetic joint between this nose and the crown wheel of the top cap is established.

Regarding the basic embodiment of the present invention, it is included in relation with said edge nose b'" in its projecting part of the top cap a a retention element c of both pieces connected between them.

In the illustrated example it is foreseen the embodiment of this retention element c as a 11 ring expanded, for example a parted metallic ring, of a ring or Seeger ring type or an entire plastic ring, in any case a ring that with adjustment in an external neck 12 of said nose b'" provides an annular projection 11' through this nose adjusts outside over the periphery of the said slot 8 of the top cap crown wheel, mantaining it firmly screwed in against the base platelet b thus both "O" rings will be right compressed in its fitting and the joints will be hermetic between both parts.

Thus, between both pieces (top cap a and platelet b) there are a large chamber 13 through which it is established an intercommunication between duct 14 of the said tubular spindle b' of the second from the power supply to the duct 15 of the said sleeve tubular projection 1 of the spout which ends in the nose 2 of the outer fluid outflow.

The corresponding communication between 14 of said spindle b' and chamber 13 is established by the extension 14' of this duct inside the tubular inner projection b" of the base platelet b by one or more slots 16 formed in the wall of the latter.

The corresponding adjustment and right grade of compression between "O" rings 7–10 can be obtained by assembling both said spout pieces, pressing on the top cap a with the base platelet b in an adequate support base (for example the same appliance as explained hereunder) and once we obtain the said compression, to proceed to the application of the retention ring c, so as to be firmly adjusted to the neck 12 of the nose b'" forming by its projecting periphery an annular projection of top 11', on the top cap crown wheel which do not let that the joint between the top cap and the base platelet and top cap and the nose be loose with the natural elastic reaction of the two "O" rings.

But it is also forseen within the scope of the present invention to provide a regulable adjustment element of said top cap a of the spout piece A over the base platelet a and the nose b'" of its central tubular projection b" through both "O" rings 7–10 that is be able to ensure the compression of both between theirs corresponding supports.

This regulable adjustment element can be complementary of the said retention element c (ring 11) that is to say that the application can be made once the spout body with this ring 11 is assembled to ensure the adjustment of both "O" rings or to replace it, having a double function thus when adjusting, it fastens both parts related between In the first stage both parts are jointed and the ring 11 is put so as to maintain assembled the base of the spout body and then, when adjusting it according to the desired features, as seen hereunder, the said regulable adjustment element is applied to ensure the fixing of the joint between both parts.

According to what is mentioned hereinabove, it is evident that with the invented disposition the basic object of the present invention is explained: to make the spout body under the shape of a wall "shell" of reduced thickness.

Finally, it is necessary to complete this body with the closing of the said nose b'" which runs through the top cap wheel crown and for that it is forseen the inclusion of an obturator element d with different dispositions hereunder explained.

In this first example (FIG. 3) it is foreseen to make the said element under the shape of a little lid that can be indistinctly applied by the exterior or the interior screwing in on the edge of said nose, providing the hermetic closing by a corresponding "O" ring 18.

Many embodiments have been foreseen regarding the obturator element d, some of them are explained hereunder, just to illustrate and pointing out that the said embodiments have no limitations.

In the layout of said FIG. 3 the obturation element is made by a little lid 17 that screwing within the edge of the nose b'" by a short inner projection 17' provides an edge flap 17" under there is a neck which houses an "O" ring 18 which is adapted to an inner coupling of the nose, forming thus a widening mouthpiece of the said duct where said projection is screwed in.

From this flap a skirt 17'" is projected which descends around the said retention ring c, adjusting or not by its edge on the top cap crown wheel a' around the slot 8.

In the first case this skirt has a aesthetic function covering the said retention ring and giving a firm support for the little lid.

In the second case (FIG. 3'), when adjusting the edge of the skirt 17'", the little lid acts as a cooperating retention element of the top cap and base platelet, related and adjusted between them through the referred first and second "O" rings 7–10, being the referred regulable adjustment element of the first and second "O" rings 7–10 and thus the assembly of the spout body.

The same happens (FIG. 3") if the little lid is outside screwed on the nose edge and adjusted by an outer "O" ring, lays on the skirt edge on the top lid without the ring 11.

It is obvious that this little lid allows (FIG. 3) not to use the referred retention ring c since it is an element of triple function: it acts at the same time as an obturation and retention element, and in the second case in a regulable way.

Consequently it is clearly established that both retention and obturator d elements can be made by independently or by one element of double or triple function when allowing a regulable adjustment of the correspondance of both pieces.

Within the scope of the present invention it is also provided that the said obturator element d is made by an integrating piece of the nose b'" such as partition wall 19 which closes from inside to the edge of said nose, with a retention element c formed by the ring 11 applied as set forth herein (FIG. 4).

In this case the nose edge can be covered by a little lid such as the variances abovementioned and acts as a cover element of such edge in the event the ring 11 is placed in which case it will be applied as shown in FIG. 4' with said obturator partition wall 19.

In the event of this little lid replaces the ring 11, it could be applied as shown in FIG. 3' actuating in the double function of a retention and regulable adjustment element.

It is obvious that in the last case no 18 auxiliary "O" ring is required since there can be some leaks from chamber 13, whose closing is controlled by the "O" ring 10 to which this little lid 17 perfectly adjusts in such double function of a retention and regulable adjustment element.

Up to now it is explained the basic embodiment of an outflow spout of faucet set to drain the fluid to the exterior whose passing is controlled by one or more faucets which form the set, separated from this spout and whose corresponding outflow canalizations are connected to the said tubular spindle or nose b' of the spout base through the "T" piece or similar.

But it is also within the scope of the present invention an interesting embodiment illustrated in FIG. 5. It is a spout which has the disposition described hereinabove and includes the retention element c formed by the ring 11 and with the nose b'" of the central tubular projection b" open to the exterior such as shown in the exemplary embodiment illustrated in FIGS. 1 and 2.

But now the obturator element d of said nose b'" is made of the body 20 of a cartridge-head with all the operative parts of an outflow control valve v and it is incorporated to the spout to perform the control herein in relation with the communication between duct 14 of the tubular spindle or nose b' of power supply connection provided by the platelet b and the said chamber 13 and to control the outflow fluid through the spout which operates directly on the said spout body, forming in that way a unique operative conjoint of valve and spout.

There is no limitation regarding to the referred replaceable cartridge-head valve, so it is pointed out as an example that it can be a valve which controls the outflow by a ninety degree turn or a higher angle or by an ascendent and descendent displacement of its obturator by one or more turns of the corresponding wheel, so that it is the reason why there are no more details regarding these valves whose illustration is based on the exterior of its body 20.

It is not important either if such cartridge-head is made of metal or plastic or if its obturator element is made of ceramic, plastic, or elastomeric or regarding the operation and activation way.

The body of said cartridge-head provides and outer inferior portion or the base 20' through which it is a screwed inside the said nose b'" of the inner tubular projection b" of the platelet base b of the spout in whose mouthpiece adjusts hermetically by a "O" ring 21 applied to a neck of its portion under an annular projection 20" by which ends on the nose edge, while the obturator (not illustrated) is operatively related to the inner spout 22 of this tubular projection b", which runs up from the platelet b level regarding a throttle 14" of the duct 14 of the referred outer tubular spindle b' and ends in annular support 23 in relation with said valve obturator operates according to the technology applied in said embodiment.

As it is easily understood this throttle 14 with its spout 22 interrupts the direct communication with the chamber 13, of the duct 14 of the tubular spindle b' of the connection to the power supply through the duct 14 of the tubular projection b" and its slots 16 since the flow deviates through the duct 22 of said spout 22 to the passage which controls the obturator inside the valve cartridge-head 20 from which the duct 14 of said tubular projection b" passes and from there to chamber 13 through its slots 16, to continue by the duct 15 of the spout sleeve and to project to the exterior through its outflow nose 2.

In this exemplary embodiment of the FIG. 5, although the retention element c is maintained between both part of the spout formed by the ring 11 the element e of regulable adjustment between them is included, formed by in this case by a tubular little sleeve 23 which is screwed in on upper portion 20'" of the body 20 of the cartridge-head that projects entirely out the spout top cap a and has an inferior edge 23' substantially trumped-shaped that surrounded the nose b'" and projected regarding this top cap, adjusts directly on the later around the said ring 11.

As is easily understood in this case, this ring can be not used since said little sleeve acts as a retention and removable adjustment element due to its characteristic of a screwed element on said body.

It is important to add that in relation with this second embodiment, there is no limitation regarding complementary elements that are obviously included to operate the valve obturator, for example a wheel which can be applied on the spindle 24 and eventually can be extended downward covering easily and free rotation the upper edge of the said little sleeve 23.

As it is easily understood the improvements of the present invention can be applied in relation to any configurations that can be adopted for the periphery of the base platelet and corresponding edge portion of the spout top cap.

Thus, for example any polygonal configuration can be adopted preferably regular and rounded vertexes and curved configuration: oval, eliptic and obviously circular as shown in these examples.

One of the particular features of these improvements is the possibility of fixing the spout in parts to the sanitary appliance to which is applied.

For example it is possible to fix the base platelet as usual adjusting the retention nut applied behind the appliance, in the projection of the tubular spindle to assemble the spout putting the top cap rightly orientated and after inserting the said "O" rings, to fix it with the retention ring c or another element provided hereinabove.

It is obvious that this assembly shall be taken care when the base platelet is not circular so as to coincide with the corresponding orientation provided by the spout.

The possibility of a greater independance in its position regarding the appliance exists with the circular base platelet, but it is necessary to take care in any case the due coincidence between the corresponding locking pieces against rotation of the spout piece regarding the base piece, that is included within the scope of the present invention, so that they have particular aplication when both pieces are corresponded by pieces that are bodies of coaxial revolution between them, as shown in this case, in which both base platelet and top cap pieces adjust between them by corresponding circular coaxial pieces between them and also with the outer nose of the tubular projection of the base platelet which runs through the crown wheel of the top cap.

As shown herein above, cooperative locking between them to avoid the rotation of the spout body A regarding its support base B are included as illustrated in exemplary embodiment of FIGS. 1, 2 and 3.

Basically these pieces comprise at least one inner projection of the base platelet b which is adapted in a cooperative inner coupling of the top cap a.

This projection of the base platelet b is formed in the wall of the central tubular projection b", as a pair of longitudinal flaps 25 parallelly spaced between them, one at each side of one of the said slots 16 of this wall which communicate the duct 14 of this projection with the chamber 13, as shown in FIG. 2.

The corresponding coupling for the projection is delimited by the spaced of two inner flaps 26 of the wall flange 5 of the later.

As shown in the said illustrations it is foreseen to provide two projections opposite between them or many of them displaced in intermediate angles which allow the application of the spout body in diferent positions regarding the base platelet with same locking.

Preferably these flaps 25 have an edge 25' by means of which are adjusted in the inner surface 5' of such wall flange 5 of the top cap a so that they provide a greater fixing to the conjoint of both pieces.

As to provide a greater fixing to the conjoint of both pieces it is foreseen the inclusion of other two flaps 27 opposite to them displaced ninety degrees regarding the abovementioned flaps pair 25 that are adjusted in the wall-flange 5 of the top cap.

As it is easily understood a way to obtain a due retention against turn between the base platelet piece and the top cap piece is to provide, in the inner lateral surface of the skirt 4' of this top cap which surrounds the periphery 6 of the base platelet and this later, cooperative pieces to establish a locking against turn of one piece regarding the other, that can be unique or complementary of the abovementioned pieces.

These pieces appear when it is a base platelet with one or more plane sectors in correspondance with others of the skirt determined for example by the given particular configuration.

In the event of poligonal configurations of base platelet and of top cap skirt, said sectors are provided by their own sides resulting from this configuration.

Regarding the variances according to basic disposition it is necessary to establish clearly that the invention is made by the disposition and element conjoint hereafter explained in the main claim and that the said is focused in the spout embodiment being the way of establishing a correspondance and adjustment between their pieces totally accessory regarding the exemplary variances, which shall not under any aspect be considered with limitations.

What is claimed is:

1. A faucet comprising:

an outflow spout comprising a spout body;

a support base supporting the outflow spout, the support base including a tubular spindle connected to a power supply, wherein the spout body and support base are separate pieces connected hermetically, the outflow spout serving as a top cap which entirely covers the support base, the support base being adapted to hold the outflow spout on a periphery of a lateral wall of the support base around a periphery of a discoidal platelet;

a first O-ring pressed between steps on each of the spout body and support base, the platelet being opposed to the tubular spindle;

a tubular central upper projection having an inner communication with a duct which rises through a crown wheel, the tubular central upper projection including a second O-ring; and an axial retention element and an obturator element disposed adjacent the duct, wherein the retention element is removably applied to the outer projection, and wherein the retention element comprises an elastically expandable ring and is applied to a neck of the outer projection, which projects peripherally and thereby forming an annular end projection over the crown wheel of the top cap.

2. The faucet of claim 1, wherein the retention element and obturator element are integrally formed.

* * * * *